United States Patent [19]

Hoshi

[11] 4,427,405

[45] Jan. 24, 1984

[54] SIGNATURE TRANSFER DEVICE IN A FOLDER FOR A ROTARY PRINTING PRESS

[75] Inventor: Toshio Hoshi, Toride, Japan

[73] Assignee: Komori Printing Machinery Co., Ltd., Japan

[21] Appl. No.: 376,321

[22] Filed: May 10, 1982

[30] Foreign Application Priority Data

May 15, 1981 [JP] Japan ..... 56-72925

[51] Int. Cl.[3] ..... B65H 45/18; B65H 45/16

[52] U.S. Cl. ..... 493/444; 493/424

[58] Field of Search ..... 493/444–445, 493/457, 424

[56] References Cited

U.S. PATENT DOCUMENTS

| | | | |
|---|---|---|---|
| 1,933,952 | 11/1933 | Zuckerman | 493/444 |
| 1,961,000 | 5/1934 | Kleinschmit | 493/444 |
| 4,093,206 | 6/1978 | Hartmann | 493/444 X |

*Primary Examiner*—A. J. Heinz

*Attorney, Agent, or Firm*—Remy J. VanOphem

[57] ABSTRACT

A signature transfer device in a folder for a rotary printing press includes a plurality of adjustable-pressure rollers for holding down upper tapes for transferring a signature with a strong force to prevent the upper tapes from slipping on the signature and hence, to prevent the latter from being inclined while the signature is being transferred toward a position in which the signature will be folded on itself by a chopper blade. The signature transfer device includes an adjustment mechanism for adjusting gaps between the upper tapes and the lower tapes to reduce the force with which the signature is sandwiched between the upper and lower tapes, so that the signature is prevented from being forcibly pressed against front lays in the folding position. With this arrangement, the signature is prevented from getting wrinkled upon abutment against the front lays, and from becoming inclined relative to the chopper blade when the signature approaches and arrives at the folding position. Therefore, desired perpendicularity of the signature relative to the chopper blade can be maintained during operation of the signature transfer device.

8 Claims, 8 Drawing Figures

SIGNATURE TRANSFER DEVICE IN A FOLDER FOR A ROTARY PRINTING PRESS

BACKGROUND OF THE INVENTION

The present invention relates to a signature transfer device for transferring signatures as cut off and folded to a discharge position in a folder for a rotary printing press.

Web-fed rotary printing presses have a folder for cutting off and folding a web which has been printed. The folder includes a signature transfer device including upper and lower tapes for transferring therebetween a signature fed from the folder, a plurality of front lays for stopping the signature, and a chopper blade for folding the signature as stopped by the front lays. Proper folding on the chopper blade requires that a leading end of the signature extends perpendicularly to the chopper blade. However, the tapes in the prior signature transfer device cannot be maintained under constant tension, and hence some tapes are liable to slip on the signature, causing the latter to be displaced at localized areas and inclined relative to the chopper blade. The tension imposed on the tapes adjacent to the front lays tends to be increased so that the signature will forcibly be pressed against the front lays, resulting in wrinkles on the leading edge of the signature. Therefore, it has been difficult for the conventional signature transfer device to gain desired perpendicularity of the signature relative to the chopper blade, and hence to fold a signature on itself with a required accuracy.

SUMMARY OF THE INVENTION

It is an object of the present invention to provide a signature transfer device having means for retaining a desired degree of perpendicularity of a signature relative to a chopper, and hence for allowing the chopper to fold the signature on itself with a required accuracy.

Another object of the present invention is to provide a signature transfer device having adjustable-pressure rollers for adjustably pressing upper tapes against lower tapes to prevent slippage between the tapes and the signature as the latter approaches the chopper, and an adjustment mechanism for loosening the upper and lower tapes on the signature as the latter is in a position to be folded by the chopper to prevent the signature from hitting front lays strongly, so that the signature will be prevented from becoming inclined relative to the chopper.

According to the present invention, there is provided a signature transfer device in a folder for a rotary printing press. The signature transfer device includes a rotating jaw cylinder for sequentially gripping and supplying signatures, a plurality of upper rollers and a plurality of lower rollers. A plurality of upper tapes extend around the upper rollers and have front ends held against peripheral surfaces of the rotatable jaw cylinder and rear ends located remotely from the rotatable jaw cylinder. A plurality of lower tapes extend around the lower rollers closely in parallel relationship to the upper tapes, and have front ends located adjacent to the rotatable jaw cylinder and rear ends remotely from the rotatable jaw cylinder. The upper and lower tapes jointly define a signature transfer path along which a signature supplied from the rotatable jaw cylinder can travel, the lower rollers around which the front ends of the lower tapes extend being disposed adjacent to the rotatable jaw cylinder downstream thereof relative to the signature transfer path, said last-mentioned lower rollers being positioned upwardly of the rotatable jaw cylinder in abutting engagement with the upper tapes. A chopper is disposed along the signature transfer path for folding a signature as transferred therealong. A plurality of front lays disposed in the, the front lays transfer path for stopping the signature being located downstream of the choppr relative to the signature transfer path. A plurality of adjustable pressure rollers are disposed upstream of the chopper for resiliently acting on the upper tapes at a position corresponding to a trailing edge of the signature as it is about to be stopped by the front lays. Finally an adjustment mechanism is adjacent to the rear ends of the upper tapes for moving the rear ends of said upper tapes towards and away from the rear ends of the lower tapes to thereby adjust the gaps between the upper and lower tapes at their rear ends.

These and other objects, features and advantages of the present invention will become apparent from the following description when taken in conjunction with the accompanying drawings in which a preferred embodiment of the invention is shown by way of illustrative example.

DETAILED OF THE PREFERRED EMBODIMENT

Figure 1:
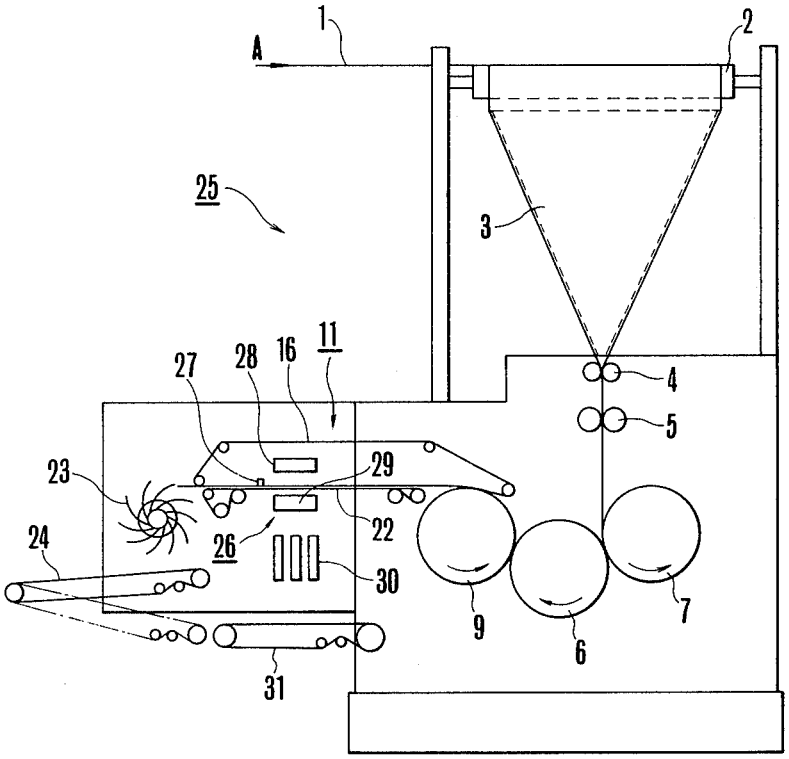
FIG. 1 is a schematic side elevational view of a conventional folder in a rotary printing press or web press.
Figure 2:
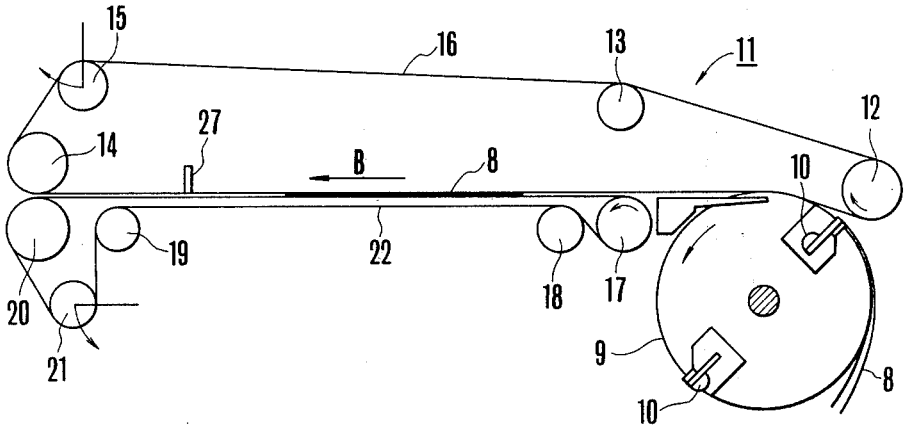
FIG. 2 is a schematic side elevational view of a signature transfer device in the folder shown in FIG. 1.

FIGS. 1 and 2 show a conventional signature transfer device 11 in a folder 25. A web 1 which has been printed travels in the direction of the arrow A (FIG. 1), is turned by a turning bar (not shown) to travel in a perpendicular direction, is subsequently caused by a drag roller 2 to be fed downwardly, and is then folded longitudinally on itself by a triangle-shaped former 3. The web 1, as thus folded, travels through a pair of guide rollers 4 and a pair of nip rollers 5 and enters between a folding cylinder 6 and a cutting cylinder 7 so as to be severed to a predetermined dimension and folded on itself into a signature 8 (FIG. 2) in a direction normal to the direction in which the web 1 has been folded by the former 3. The signature 8 is fed into the signature transfer device 11, as shown in FIG. 2, by a gripper plate 10 on a rotatable jaw cylinder 9 which grips a leading end of the signature 8.

Figure 3:
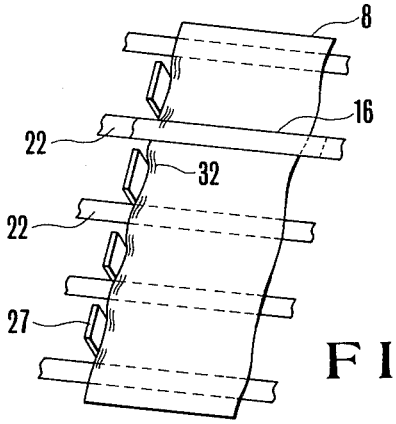
FIG. 3 is a fragmentary perspective view showing the way in which a signature is stopped by front lays.

The signature transfer device 11 includes, as shown in FIG. 2 a plurality of parallel upper continuous tapes 16 extending around tape rollers 12, 13, 14 and a tensioning roller 15, and a plurality of parallel lower continuous tapes 22 extending around tape rollers 17, 18, 19, 20 and a tensioning roller 21. The signature 8 travels forward in the direction of the arrow B as it is sandwiched between parallel runs of the upper and lower tapes 16 and 22, as illustrated in FIG. 3. The signature 8 thus transferred is discharged out of the signature transfer device 11 so as to be received between adjacent paddles of a fan wheel 23 (FIG. 1), from which the signature 8 is discharged onto a discharge conveyor 24. The signature 8 is then transferred from the discharge conveyor 24 out of the folder 25 onto a stack of signatures (not shown).

The folder 25, as shown in FIG. 1, includes a chopper 26 which is selectively actuatable dependent on the type of the signature 8 used. More specifically, a plurality of abutments or front lays 27 are disposed along a signature transfer path jointly defined by the parallel runs of the upper tapes 16 and the lower tapes, 22, and are positioned between adjacent tapes, as shown in FIG. 3. The signature 8 being transferred along this signature transfer path is stopped by the front lays 27 when a leading end of the signature 8 abuts against the front lays 27. A chopper blade 28, which is in the form of a thin plate, and a pair of grip rollers 29 are disposed upstream of the front lays 27 with respect to the signature transfer path and are actuatable in synchronization with operation of the folder 25. The chopper blade 28 is positioned above the signature transfer path, and the grip rollers 29 are positioned below the signature transfer path. The signature 8, which has been stopped by the front lays 27, is thus folded on itself by the chopper blade 28 in a direction normal to the direction in which the signature 8 has been folded on itself by the folding cylinder 6, and is introduced between the grip rollers 29. The folded signature 8 is then discharged by the grip rollers 29 and fan wheels 30 onto a discharge conveyor 31 located below the fan wheels 30. At this time, the discharge conveyor 24 is inclined in the lowered position, as shown in FIG. 1 in phathom lines for coaction with the discharge conveyor 31. Therefore, the signature 8 can be transferred by the discharge conveyors 31 and 24 out of the folder 25.

In order for the signature 8 to be properly folded on itself by the chopper 26, it is necessary that the signature 8, as stopped by the front lays 27, have its leading edge extending perpendicularly to the chopper blade 28. With the illustrated conventional signature transfer device, however, it has been difficult for all of the parallel upper and lower continuous tapes 16 and 22 arranged across the signature 8 to be maintained under constant tension, and hence some of the tapes are liable to slip on the signature 8, with the result that those portions of the signature 8 which are held against slipping tapes tend to be fed more slowly than the other portions of the signature 8 are transferred. Thus, the desired perpendicularity of the signature 8 cannot be gained. Since the parallel upper and lower continuous tapes 16 and 22 are subjected to excessive tension adjacent to the front lays 27, the signature 8 which has been fed at a high speed is forcibly pressed against the front lays 27, whereupon the leading end of the signature 8 becomes wrinkled as shown at 32 in FIG. 3. The signature 8 also tends to get skewed when the parallel upper and lower continuous tapes 16 and 22 on both sides of each front lay 27 are differently tensioned such as to bring the leading edge of the signature 8 into pressed engagement with the front lay 27 with different forces on its respective sides. Consequently, the signature 8 cannot be folded on itself by the folder blade with the desired accuracy.

A signature transfer device 111 according to the present invention will now be described with reference to FIGS. 4 through 8. Like or corresponding parts are denoted by like or corresponding reference characters throughout FIGS. 1 through 8 except for the signature transfer device 111.

Figure 4:
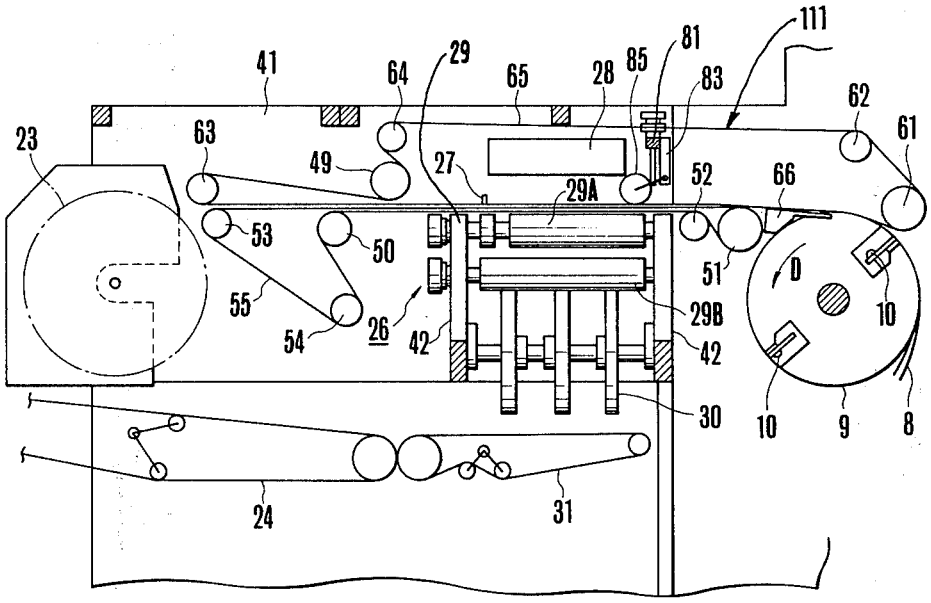
FIG. 4 is a schematic side elevational view of a signature transfer device in a folder according to the present invention, showing signature transfer and discharge sections.
Figure 5:
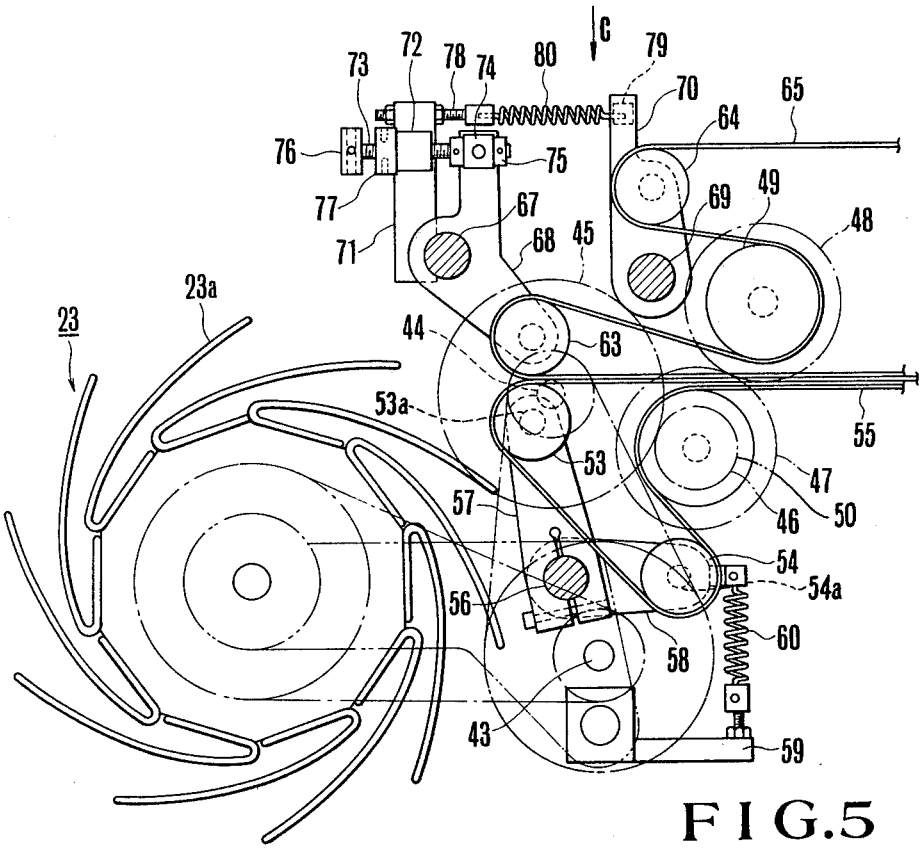
FIG. 5 is an enlarged side elevational view of an end portion of the signature transfer device.
Figure 6:
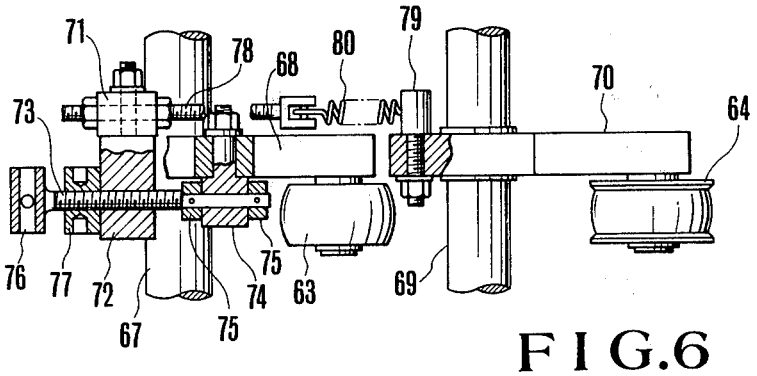
FIG. 6 is a plan view, partly cut away, as viewed in the direction of the arrow C of FIG. 5.

As shown in FIG. 4, a jaw cylinder 9 is rotatably mounted on a folder frame 41 and is rotatable about its own central axis in the direction of the arrow D. The folder frame 41 supports at its rear end portion a fan wheel 23 rotatably mounted thereon and having a plurality of radial paddles 23*a* (FIG. 5). A discharge or delivery conveyor 24 is located below the fan wheel 23. A chopper 26 is positioned between the jaw cylinder 9 and the fan wheel 23. The chopper 26 is composed of a chopper blade 28, a strip roller assembly 29 including an upper pair of strip rollers 29A and a lower pair of grip rollers 29B, each rotatably journalled on chopper frames 42, and a plurality of fan wheels 30 positioned below the grip rollers 29A and 29B. A discharge or delivery conveyor 31 underlies the chopper 26.

As illustrated schematically in FIG. 5, the folder frame 41 also supports a drive shaft 43 drivably connected to a drive source, and an intermediate shaft 44 drivably coupled to the drive shaft 43. The drive shaft 43 and the intermediate shaft 44 are located rearward on the fan wheel 23. The drive shaft 43 is positioned below the intermediate shaft 44. An upper drive roller 49 and a lower drive roller 50 are rotatably mounted on the folder frame 41 rearward of the drive and intermediate shaft 44. The upper drive roller 49 is drivably coupled to the intermediate shaft 44 through a train of gears 45, 46 47 and 48. The lower drive roller 50 is located below the upper drive roller 49 and is drivably coupled to the intermediate shaft 44 through the gears 45 and 46.

Referring again to FIG. 4, the lower tape rollers 51 are disposed adjacent to and downstream of the jaw cylinder 9, and have upper peripheral surfaces positioned slightly higher than the upper peripheral surface of the jaw cylinder 9, the lower tape rollers 51 being rotatably mounted on the folder frame 41. A pulley shaft (not shown) is mounted on the folder frame 41 downstream of the lower tape rollers 51 and supports thereon a plurality of guide pulleys 52 spaced axially of the pulley shaft. A plurality of lower tapes 55 extend around the lower drive roller 50, the lower tape rollers 51, the guide pulleys 52, a plurality of guide pulleys 53, and a plurality of tension pulleys 54. The lower tapes 55 have upper and lower horizontal runs extending closely to each other between a chopper blade 28 and the grip roller assembly 29 of the chopper 26. As illustrated in FIG. 5*a* stay 56 secured to the folder frame 41 and disposed upwardly of the drive shaft 43 supports a pair of roller arms 57 having ends grippingly mounted on the stay 56 and adjustable in their angular position relative thereto. The guide pulleys 53 are mounted at spaced locations on a pulley shaft 53*a* supported on distal ends of the rollers arms 57. The tension pulleys 54 are similarly mounted at spaced locations on a pulley shaft 54*a* supported on distal ends of a pair of roller arms 58 loosely mounted on the stay 56. Tension springs 60 act between the distal ends of the roller arms 58 and spring supports 59 affixed to the folder frame 41 and normally urge the pair of roller arms 58 in a clockwise direction as viewed in FIG. 5. Thus, the tension springs 60 maintin tension in the lower tapes 55.

As shown in FIG. 4, the upper tape rollers 61 are disposed adjacent to and upstream of the jaw cylinder 9. A pulley shaft (not shown) is mounted on the folder frame 41 obliquely upwardly of and downstream of the jaw cylinder 9, and supports thereon an plurality of guide pulleys 62 rotatably mounted at axially spaced locations. A plurality of upper tapes 65 extend around the upper drive roller 49, the upper tape rollers 61, the guide pulleys 62, a plurality of additional guide pulleys 63, and a plurality of tension pulleys 64. The upper tapes 65 have lower horizontal runs extending parallel and adjacent to the upper horizontal runs of the lower tapes 55. The upper tapes 65 have front or upstream ends held in contact with peripheral surfaces of the jaw cylinder 9. The lower tape rollers 51 are located higher than the jaw cylinder 9 as described above. The arrangement makes it possible for the upper tapes 65 to be held against the lower tapes 55 on the lower tape rollers 51 in overlapping relation. A sheet guide 66 which is located adjacent to the peripheral surface of the jaw cylinder 9 is inclined so as to extend along the upper tapes 65. The lower and upper runs of the upper and lower tapes 65 and 55, which extend parallel to each other, jointly define a transfer path along which a signature 8 can travel in a direction from the jaw cylinder 9 toward the fan wheel 23. A plurality of front lays 27 are supported on the chopper frame 42 and positioned in the signature transfer path downstream of the chopper blade 28. The front lays 27 project upwardly between the adjacent upper tapes 65.

Referring to FIGS. 5 and 6*a* stay 67 is mounted on the folder frame 41 and located upwardly of rear or downstream ends of the upper tapes 65. A plurality of pulley arms 68 are loosely fitted over the stay 67 in conformity with the upper tapes 65. The guide pulleys 63 are each rotatably mounted on distal ends of one of the pulley arms 68. Another stay 69 is mounted on the folder frame of the stay 67. A plurality of pulley arms 70 are loosely mounted on the stay 69 in conformity with the upper tapes 65. The tension pulleys 64 are rotatably mounted on distal ends of the pulley arms 70. A plurality of brackets 71 are secured to the stay 67, each being in substantial alignment with one of the pulley arms 68, and each having an upper end thereof a stud 72 pivotably mounted thereto. Adjustment screws 73 extend threadedly through the studes 7*d*. The adjustment screws 73 have unthereaded distal ends fitted in studs 74 which are attached to upper ends of the pulley arms 68. The adjustment screws 73 are prevented by collars 75 from being axially moved relative to the studs 74. The adjustment screws 73 have wrench receivers 76. When the adjustment screws 73 are turned by a wrench engaging the wrench receivers 76, the pulley arms 68 are angularly moved to displace the guide pulleys 63 upwardly and downwardly for adjusting the gaps between the upper tapes 65 and the lower tapes 55, mainly in their downstream half portions. After such an adjustment has been completed, nuts 77 are fastened to fix the adjustment screws 73 in the adjusted positions. Tension springs 80 each act between distal ends of one of a plurality of adjustment screws 78 each axially movably threaded through upper ends of one of the brackets 71, and studs 79 pivotably mounted in upper ends of the pulley arms 70. The pulley arms 70 are normally urged by the tension springs 80 to turn counterclockwise as viewed in FIG. 5. Thus, the upper tapes 65 are tensioned by the tension pulleys 64.

Figure 7:
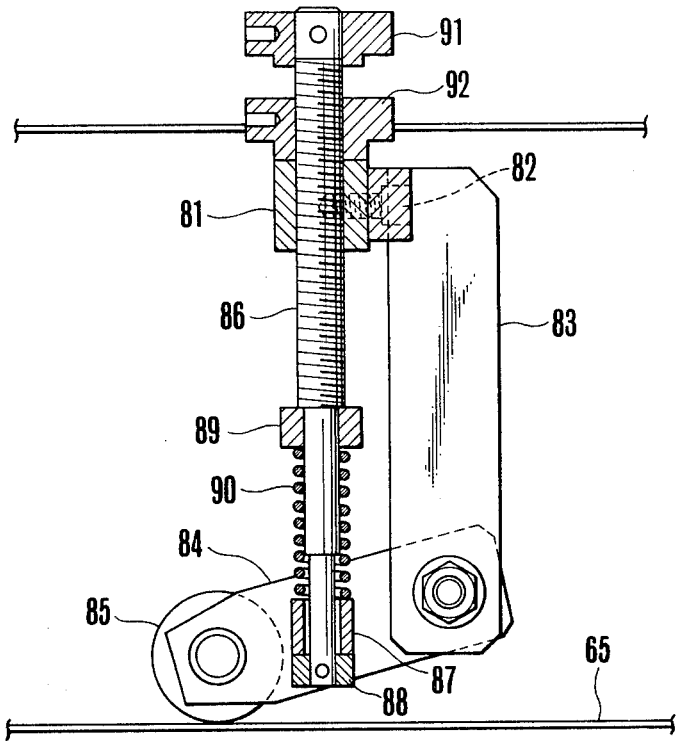
FIG. 7 is a longitudinal cross-sectional view of an adjustable-pressure roller assembly.
Figure 8:
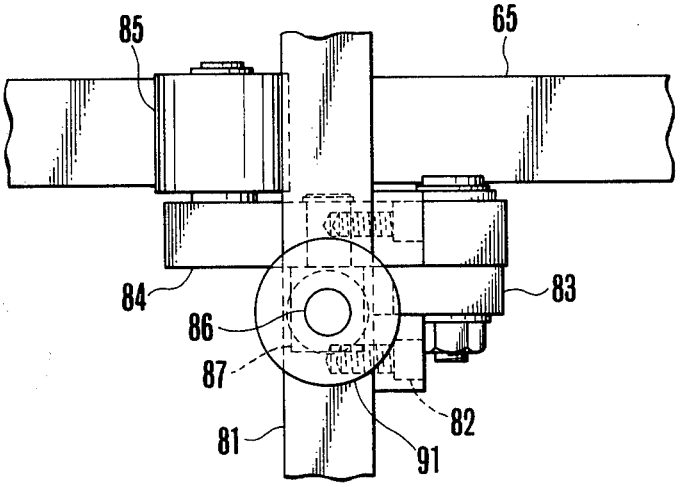
FIG. 8 is a plan view of the adjustable-pressure roller assembly shown in FIG. 7.

A stay 81 having a substantially square cross section is mounted horizontally on the folder frame 41 upstream of the chopper blade 28, as shown in FIG. 4. The details of the stay 81 and associated elements are illustrated in FIGS. 7 and 8. A plurality of brackets 83 depend from and are secured by bolts 82 to the stay 81 in conformity with the upper tapes 65. The brackets 83 are pivotally interconnected on their lower ends with roller arms 84. The roller arms 84 support on the distal ends thereof presser rollers 85 rotatably mounted thereto and biased into engagement around their peripheries with upper surfaces of the upper tapes 65. Adjustment screws 86 threadedly extend vertically through the stay 81 and have lower unthreaded ends fitted in studs 87 each pivotably attached to one of the roller arms 84. The adjustment screws 86 are prevented by collars 89 from being moved upwardly relative to the roller arms 84. The roller arms 84 are normally biased to turn counterclockwise, as viewed in FIG. 7, by compression coil springs 90 disposed between the collars 89 and the studs 87 and wound about the adjustment 86. The presser rollers 85 are thus pressed against the upper surfaces of the upper tapes 65 under the biasing force of the springs 90. When a suitable wrench (not shown) engages wrench receivers 91 fixed to upper ends of the adjustment screws 86 and turns the latter, the adjustment screws 86 can be vertically moved to adjust the force with which the presser rollers 85 are pressed against the upper tapes 65. After the pressing force has been adjusted, nuts 92 are fastened to fix the adjustment screws 86 in the adjusted position. The presser rollers 85 are positioned such that they are above the trailing edge of the signature 8 as it is about to be stopped by the front lays 27 in a position in which the signature 8 can be folded on itself by the chopper 26.

Operation of the signature transfer device 111 and the chopper thus constructed will now be described. After a signature 8 has been severed and folded, it is gripped by a gripper plate 10 on the jaw cylinder 9, and is fed between the upper and lower tapes 65 and 55 beyond the sheet guide 66 while the jaw cylinder 9 rotates in the direction of the arrow D (FIG. 4). The signature 8 is then sandwiched between and transferred by the upper and lower tapes 65 and 55. When a leading edge of the signature 8 abuts against the front lays 27, the signature 8 is stopped while the upper and lower tapes 65 and 55 are allowed to move along. At the same time, the chopper blade 28 is lowered to a transverse center of the signature 8 and pushes the latter between the grip rollers 29A as the signature 8 is folded on itself. The signature 8 thus folded is caused to pass through the grip rollers 29B and the fan wheels 30 onto the discharge conveyor 31. The folded signature 8 is now discharged by the discharge conveyors 31 and 24 out of the folder onto a stack of signatures which have been folded.

Prior to the foregoing signature transferring and folding operations, the force with which the upper and lower tapes 65 and 55 are pressed against the signature 8 is adjusted in the following manner. The nuts 92 (FIG. 7) on the adjustment screws 86 are loosened and the adjustment screws 86 are turned with a wrench engaging the wrench receivers 91, whereupon the presser rollers 85 are caused to move upwardly or downwardly to adjust the force with which the tapes are pressed donwardly. Thus, the signature 8 can be transferred by the upper and lower tapes 65 and 55 to the folding position with the leading edge of the signature 8 extending perpendicularly to the chopper blade 28, without allowing the upper and lower tapes 65 and 55 to slip on the signature 8 transversely across the latter. With the lower tape rollers 51 raised relative to the jaw cylinder 9 to bring the upper tapes 65 into contact with the lower tapes 55 along an inclined path from the jaw cylinder 9 to the lower tapes 55, the signature 8 can be sandwiched between the upper tapes 65 and the lower tapes 55 with an increased force. The above arrangement allows the signature 8 to be gripped firmly and the position of the signature to be controlled more reliably.

Then, the gaps between the upper and lower tapes 65 and 55 are adjusted dependent on the number of pages, the properties of sheets, the thickness, and other factors of the signature 8 for stopping the signature 8 in the desired fashion at the front lays 27. More specifically, the nuts 77 (FIGS. 5 and 6) are first loosened and the adjustment screws 73 are turned about their axes with a wrench engaging the wrench receivers 76, whereupon the guide pulleys 63 are moved upwardly or downwardly to select desired gaps between the upper and lower tapes 65 and 55 transversely full across the signature 8. The force with which the signature 8 can be sandwiched between the upper and lower tapes 65 and 55 can thus be weakened to the point where the upper and lower tapes 65 and 55 will slip on a front half of the signature 8, preventing the leading edge of the signature 8 from being pressed strongly against the front lays 27. Therefore, with the signature transfer device 111 of the present invention, there is no risk of causing wrinkles on the leading end of the signature 8 or tilting the latter relative to the chopper blade 28. The signature 8 thus can be stopped by the front lays 27 with desired perpendicularity at a position in which the signature 8 can be folded on itself by the chopper blade 28. Since the upper tapes 65 are maintained under desired tension at all times by the tension pulleys 64 which are spring-biased, the upper tapes 65 will remain tensioned to a desired degree even when the guide pulleys 63 are adjusted for varying the gaps between the upper and lower tapes.

Although a certain preferred embodiment has been shown and described in detail, it should be understood that various changes and modifications may be made thereto without departing from the scope of the appended claims.

What is claimed is:

1. A signature transfer device in a folder for a rotary printing press, comprising:

a rotatable jaw cylinder for gripping and supplying signatures one at a time;

a plurality of upper rollers;

a plurality of upper continuous tapes extending around said plurality of upper rollers in a substantially horizontal orientation and having front ends held against peripheral surfaces of said rotatable jaw cylinder and rear ends located remotely from said rotatable jaw cylinder;

a plurality of lower rollers;

a plurality of lower continuous tapes extending around said plurality of lower rollers closely in parallel relationship to and disposed below said upper continuous tapes, and having front ends located adjacent to said rotatable jaw cylinder and rear ends located remotely from said rotatable jaw cylinder, said upper and lower continuous tapes jointly defining therebetween a signature transfer path along which a signature supplied from said rotatable jaw cylinder can travel, said lower rollers around which said front ends of said lower continuous tapes extend being disposed adjacent to said rotatable jaw cylinder downstream thereof relative to said signature transfer path, the peripheral surface of said last-mentioned lower rollers being positioned higher than said peripheral surface of said rotatable jaw cylinder in abutting engagement with said upper continuous tapes;

a chopper folder disposed along said signature transfer path for folding a signature as transferred therealong;

a plurality of front lays disposed in said signature transfer path for stopping said signature at a folding location and located downstream of said chopper folder relative to said signature transfer path;

a plurality of adjustable-pressure rollers disposed upstream of said chopper folder for resiliently acting on said upper continuous tapes at a position corresponding to a trailing edge of said signature as it is about to be stopped by said front lays in a position in which said signature can be folded on itself by said chopper folder; and an adjustment mechanism disposed adjacent to said rear ends of said upper and lower continuous tapes for moving said rear ends of said upper continuous tapes toward and away from said rear ends of said lower continuous tapes to thereby adjust gaps between said upper and lower continuous tapes to adjust the contact of said upper and lower continuous tapes on said signatures at their respective rear ends.

2. A signature transfer device according to claim 1, wherein at least one of said adjustable-pressure rollers comprises an adjustment screw, a roller arm pivotably mounted on said adjustment screw and supporting thereon said adjustable-pressure roller, and a compression coil spring acting between said adjustment screw and said roller arm for normally urging said adjustable-pressure roller against said upper continuous tapes.

3. A signature transfer device according to claim 1, wherein said adjustment mechanism comprises guide pulleys around which said upper tapes extend, pulley arms supporting thereon said guide pulleys, and adjustment screws acting on said pulley arms for moving said guide pulleys toward and away from said lower continuous tapes.

4. A signature transfer device according to claim 3, wherein at least one of said adjustable-pressure rollers comprises an adjustment screw, a roller arm pivotably mounted on said adjustment screw and supporting thereon said adjustable-pressure roller, and a compression coil spring acting between said adjustment screw and said roller arm for normally urging said adjustable-pressure roller against said upper continuous tapes.

5. A signature transfer device in a folder for a rotary printing press, said folder having a rotatable jaw cylinder for gripping and supplying signatures one at a time to said signature transfer device and having a predetermined direction of angular rotation, said signature transfer device comprising:

a plurality of first rollers;

a plurality of first continuous tapes extending around said plurality of first rollers and having first ends biased against peripheral surfaces of said rotatable jaw cylinder and second ends located remotely from said rotatable jaw cylinder;

a plurality of second rollers;

a plurality of second continuous tapes extending around said plurality of second rollers closely in parallel relationship to said first continuous tapes, and having first ends located adjacent to said rotatable jaw cylinder and spaced away therefrom and second ends located remotely from said rotatable jaw cylinder, said first and second continuous tapes jointly defining therebetween a generally planar signature transfer path along which a signature supplied from said rotatable jaw cylinder can travel, said plurality of second rollers around which said first ends of said continuous tapes extend being disposed adjacent to said rotatable jaw cylinder downstream thereof relative to said signature transfer path and further being positioned in abutting engagement with said first and second continuous tapes such as to curve said generally planar signature transfer path a predetermined angular amount therearound in said predetermined angular direction so as to bias said first and second continuous tapes together;

chopper folder means disposed along said generally planar signature transfer path for folding a signature as transferred therealong;

a plurality of abutment means disposed in said generally planar signature transfer path for stopping said signature and located downstream of said chopper folder means relative to said generally planar signature transfer path;

a plurality of adjustable-pressure means disposed upstream of said chopper folder means for varying biasing pressure on said first continuous tapes to bias said first continuous tapes toward said second continuous tapes at a position correspond to a trailing edge of said signature at it is about to be stopped by said abutment means in a position in which said signature can be folded on itself by said chopper folder means; and adjustment means disposed adjacent to said second ends of said first and second continuous tapes for moving said second ends of said first continuous tapes towards and away from said second ends of said second continuous tapes to thereby adjust the gaps between said first and second continuous tapes at their respective second ends.

6. A signature transfer device according to claim 5, wherein said adjustable-pressure means comprises an adjustment screw, a roller arm pivotably mounted on said adjustment screw and supporting thereon an adjustable-pressure roller, and a compression coil spring acting between said adjustment screw and said roller arm for normally urging said adjustable-pressure roller against said first continuous tapes.

7. A signature transfer device according to claim 5, wherein said adjustment means comprises guide pulleys around which said first continuous tapes extend, pulley arms supporting thereon said guide pulleys, and adjustment screws acting on said pulley arms for moving said guide pulleys towards and away from said second continuous tapes.

8. A signature transfer device according to claim 7, wherein said adjustable-pressure means comprises an adjustment screw, a roller arm pivotably mounted on said adjustment screw and supporting thereon an adjustable-pressure roller, and a compression coil spring acting between said adjustment screw and said roller arm for normally urging said adjustable-pressure roller against said first continuous tapes.

* * * * *

UNITED STATES PATENT AND TRADEMARK OFFICE

CERTIFICATE OF CORRECTION

PATENT NO. : 4,427,405

DATED : January 24, 1984

INVENTOR(S) : Toshio Hoshi

It is certified that error appears in the above-identified patent and that said Letters Patent is hereby corrected as shown below:

Column 2, line 6, after "lays" insert ---- are ----. Same line, delete ", the front lays transfer" and insert ---- signature transfer ----.

Column 2, line 45, after "DETAILED" insert ---- DESCRIPTION ----.

Column 4, line 32, after "drive" insert ---- shaft 43 ----.

Column 4, line 35, after "46" insert a comma ---- , ----.

Column 4, line 68, delete "maintin" and insert ---- maintain ----.

Column 5, line 5, delete "an" and insert ---- a ----.

Column 5, line 48, delete "unthereaded" and insert ---- unthreaded ----.

Column 6, line 21, after "adjustment" insert ---- screw ----.

UNITED STATES PATENT AND TRADEMARK OFFICE

CERTIFICATE OF CORRECTION

PATENT NO. : 4,427,405

DATED : January 24, 1984

INVENTOR(S) : Toshio Hoshi

It is certified that error appears in the above-identified patent and that said Letters Patent is hereby corrected as shown below:

In the Claims

Column 8, line 4, delete "face" and insert ---- faces ----.

Column 9, line 32, delete "correspond" and insert ---- corresponding ----.

Column 9, line 33, delete "at" and insert ---- as ----.

In the Abstract

Line 9, after "device" insert ---- also ----.

Signed and Sealed this

*Twenty-sixth* Day of *March 1985*

[SEAL]

*Attest:*

DONALD J. QUIGG

*Attesting Officer* *Acting Commissioner of Patents and Trademarks*